United States Patent [19]

Kramer et al.

[11] Patent Number: 4,463,880

[45] Date of Patent: Aug. 7, 1984

[54] MEDICINE DROP DISPENSER WITH ANTI-BACTERIAL FILTER

[75] Inventors: Steven G. Kramer; Edward Q. Yavitz, both of San Francisco, Calif.

[73] Assignee: The Regents of the University of California, Berkeley, Calif.

[21] Appl. No.: 373,355

[22] Filed: Apr. 30, 1982

[51] Int. Cl.[3] ..... B67D 5/58

[52] U.S. Cl. ..... 222/189; 222/420

[58] Field of Search ..... 222/420, 189, 215; 604/126, 263, 192; 210/466, 477

[56] References Cited

U.S. PATENT DOCUMENTS

| | | | |
|---|---|---|---|
| 3,149,758 | 9/1964 | Bush et al. | 222/189 |
| 3,270,743 | 9/1966 | Gingras | 604/192 |
| 3,361,304 | 1/1968 | Thompson | 222/189 |
| 3,463,322 | 8/1969 | Gerarde | 222/189 X |
| 3,756,472 | 9/1973 | Vos | 222/189 |
| 3,760,987 | 9/1973 | Meterhoefer | 222/189 X |

*Primary Examiner*—Stanley H. Tollberg

*Attorney, Agent, or Firm*—Phillips, Moore, Lempio & Finley

[57] ABSTRACT

A liquid dispenser comprises a container defining a liquid retaining chamber therein and at least one dispensing port defined through an upper end of the dispenser for providing the sole dispensing outlet for liquid from the chamber. A hydrophobic and microporous anti-bacterial filter is secured over the port to provide a barrier to the ingress of bacteria and particulate matter therethrough and for permitting the egress of sterile liquid therethrough. The dispenser is preferably constructed at its upper end to coalesce the liquid into droplet form upon dispensing thereof.

17 Claims, 8 Drawing Figures

MEDICINE DROP DISPENSER WITH ANTI-BACTERIAL FILTER

DESCRIPTION

TECHNICAL FIELD

This invention relates generally to a medicine drop dispenser and more particularly to a squeeze-bottle type dispenser having a hydrophobic and microporous anti-bacterial filter secured over a dispensing outlet thereof.

BACKGROUND ART

Liquid dispensers of the squeeze-bottle type are utilized for dispensing medicinal solutions in droplet form. Conventional dispensers normally include a container composed of a resilient plastic material and a cap having a dispensing aperture formed therethrough. The liquid solution contained in the dispenser is commonly intermixed with a chemical disinfectant or preservative, such as thimerosal, that may induce an allergic reaction in a particular user. In addition, particulate matters suspended in the solution are generally dispensed with the droplets and may cause irritation in the eye of the user. Another problem encountered with conventional dispensers of this type is that bacteria may enter the container through the dispensing aperture to contaminate the liquid solution contained therein.

Although various attempts have been made to provide squeeze-bottle type dispensers with filters to prevent the ingress of bacteria and particulate matters therein, such dispensers have not fully solved the problems set forth above. U.S. Pat. No. 3,149,758, for example, discloses a squeeze-bottle type dispenser wherein hydrophilic and hydrophobic filters are secured within the cap of the dispenser in an attempt to filter out microorganisms and the like.

DISCLOSURE OF INVENTION

This invention overcomes the above briefly-described problems by providing a liquid dispenser comprising a container defining a liquid retaining chamber therein, a dispensing means defined at an upper end of the dispenser for providing the sole dispensing outlet from the chamber, and an anti-bacterial filter means secured over the dispensing means for providing a barrier to the ingress of bacteria and particulate matter therethrough and for permitting the egress of sterile liquid therethrough.

In one aspect of this invention, the filter means is entirely hydrophobic and microporous and is secured in exposed relationship over the dispensing means and further functions to repel residual liquid therefrom.

In another aspect of this invention, means are provided for inducing coalescence of dispensed liquid into droplet form, including a convex surface formed on the upper end of the dispenser and having the dispensing means defined therethrough and the filter means secured thereover.

In still another aspect of this invention, the dispensing means comprises a plurality of spaced ports formed through the convex surface of the dispenser and having a composite cross-sectional area approximating 1.0 mm.

In still another aspect of this invention, a cap is disposed on an upper end of the dispenser and the dispensing means includes a plurality of spaced ports formed through a centrally-disposed and convex outer surface of the cap.

In still another aspect of this invention, a detachable cap is mounted on the upper end of the dispenser and has a disinfectant pad therein that overlies, directly contacts and entirely covers the exposed filter means when the cap is in its closed position on the dispenser.

As described more fully hereinafter, the dispenser is preferably of the squeeze-bottle type, adapted to contain a liquid solution possessing curative or remedial properties, such as a saline solution or a medicinal solution having appropriate pharmacological additives intermixed therein. The filter is preferably hydrophobic to ensure that no residual solution remains on the outer surface of the filter means for potential contamination by ambient conditions. The repellent nature of the filter means will provide that even the last drop of liquid solution, falling back into the container, will be bacteria free. Thus, sterility of the solution will be maintained regardless of the number of times the solution is dispensed and no chemical disinfectant or preservative is required for the solution. The latter desideratum is important in respect to chemical disinfectants or preservatives that may cause an allergic reaction in a particular user.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
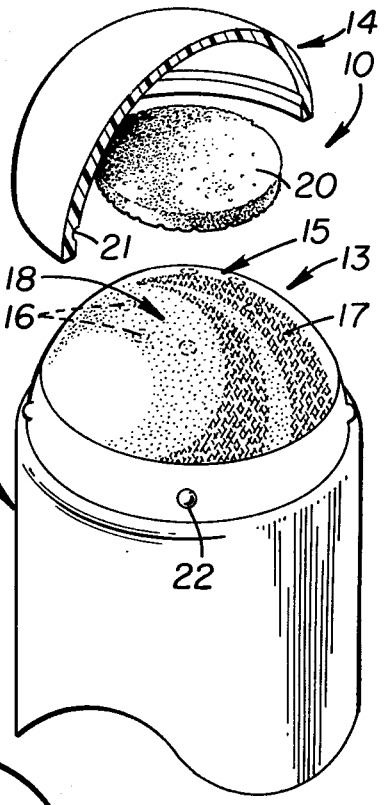
FIG. 1 is an exploded, isometric view partially illustrating a liquid dispenser embodiment of the present invention.
Figure 2:
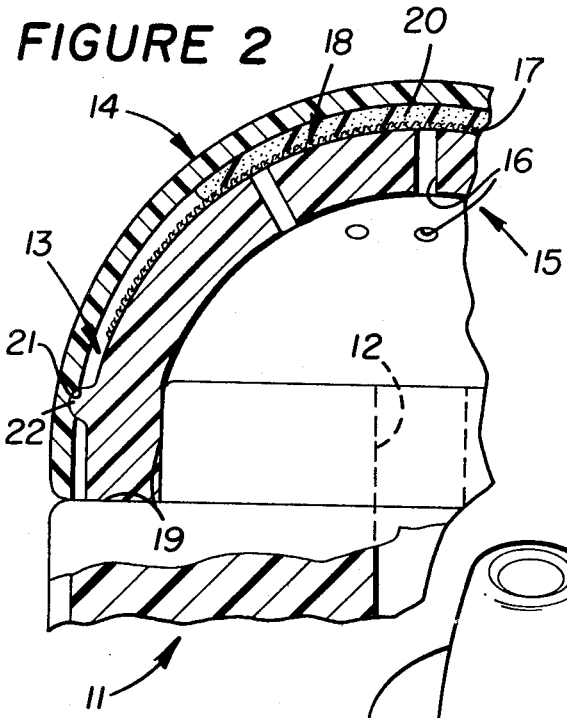
FIG. 2 is an enlarged sectional view through an upper end of the dispenser.

FIGS. 1 and 2 illustrate a liquid dispenser 10 of the squeeze-bottle type comprising a thin-walled plastic container 11 defining a liquid retaining chamber therein, terminating at an outlet passage 12. A fixed first cap 13 is secured on an upper end of the container, whereas a removable second cap 14 is detachably mounted on the container to cover the first cap. Container 11 is composed of a suitable resilient and squeezable plastic material, such as polyethylene, whereas the caps may be formed of a more rigid and non-squeezable standard plastic material.

As more clearly shown in FIG. 2, a dispensing means 15, shown in the form of a plurality of ports 16 formed through cap 13 at an upper end of the dispenser, provide the sole outlet for the liquid retained in chamber 12. A hydrophobic and microporous anti-bacterial filter 17 is secured on cap 13 and stretched over the ports to provide a barrier to the ingress of bacteria and particulate matter therethrough and to further provide sufficient porosity to permit the egress of sterile liquid therethrough for medicinal purposes. For example, the filter may be constructed in fabric form and composed of polycarbonate (with or without glass fiber reinforcement) to provide a pore size in the range of 0.2 micron.

Standard filters of this type are manufactured by Nuclepore Co. of California.

The filter may be suitably secured to the outer surface of cap 13 by a conventional method, such as by molecular bonding using a brief exposure to acetone and pressure. The acetone should not, of course, cover the areas of the filter overlying ports 16. In fact, it is preferred that a circular surface area 18 defined within and between the circumferentially disposed ports (FIG. 1) remain unsecured to cap 13 for purposes hereinafter described.

It should be noted in FIGS. 1 and 2 that outer surface 18 of cap 13 is preferably convex, when viewed in cross section. This convex configuration at the apical of cap 13 in the area of ports 16 will induce the dispensed liquid to coalesce into a single droplet form when expelled from the dispenser upon inversion thereof and squeezing of container 11. Surface 18 may be formed semi-spherical, paraboloidal, hyperboloidal, or the like. Hereinafter-described dispenser embodiment **10*d*, illustrated in FIGS. 7 and 8, suggests that corresponding surface 18*d*** and the overlying filter can be configured flat, but in no event concave.

Although FIG. 1 illustrates a single, centrally-disposed port 16 and eight circumferentially-disposed ports, it should be understood that the selected number and sizes of the ports will depend upon the particular dispensing application under consideration. It is desirable that the composite surface area of filter 17, covering ports 16, be sufficiently large to facilitate easy dispensing of the liquid, i.e., the force required to squeeze container 11 to force liquid through ports 16 and filter 17 to form a droplet decreases in proportion to an increase in the composite surface area of the filter covering the ports.

The maximum composite area of ports 16 will be determined to a large extent by the diameter of a standard dropper bottle and the cost of the filter material. For example, assuming that cap 13 and filter 17 are secured on the dispensing spout or neck of a standard dropper bottle having a standard 1 mm. dropper opening (e.g., similar to that shown in FIG. 3), the composite area of ports 16 would be greater than 1 mm., e.g., 0.5 mm. in diameter each. It should be further understood that the diameters of the ports could be varied in respect to each other to further induce the above-mentioned coalescence of liquid into single droplet form.

As more clearly shown in FIG. 2, cap 13 may be adhesively or otherwise suitably secured within an annular recess 19 formed at an upper end of the neck of container 11 to form an integral part thereof. If so desired, removable cap 14 may have a disinfectant-soaked pad 20 secured thereunder to engage and cover at least the portion of filter 17 overlying ports 16 during storage. The cap may be releasably attached to underlying cap 13 by any suitable means, such as an annular groove 21 formed interiorly of cap 14 and adapted to snap-fit upon flexing of the cap over a plurality of circumferentially-spaced lugs 22. Alternatively, outer cap 14 can be modified to extend downwardly into threaded engagement with threads formed on a lower portion of the neck of the container in a conventional manner (similar to that shown in FIG. 3).

Figure 3:
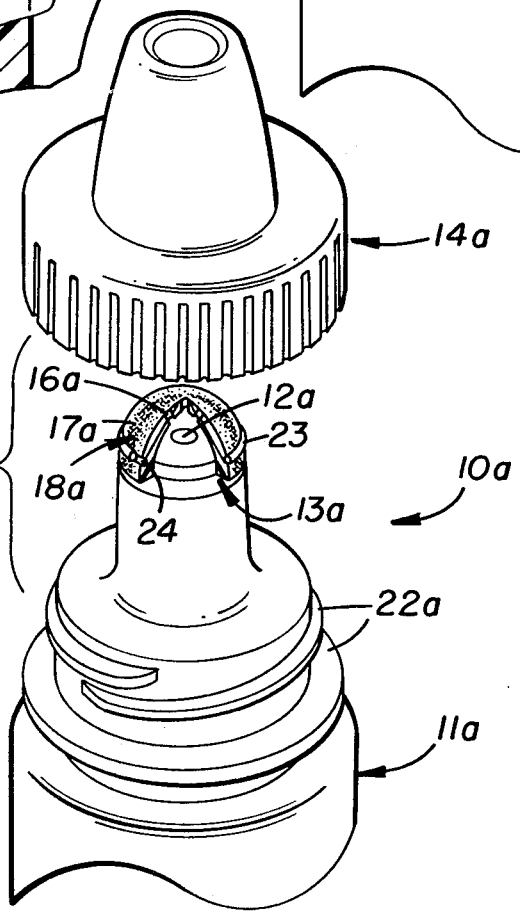
FIG. 3 is a partially sectioned isometric view, similar to FIG. 1, but illustrating a second dispenser embodiment.

FIG. 3 illustrates a second dispenser embodiment **10*a* wherein identical numerals depict corresponding constructions and wherein numerals appearing in FIG. 3 are each accompanied by an "a". Dispenser 10*a* is generally in the form of a standard dropper bottle and differs from dispenser 10 in that a filter 17*a* of larger diameter is stretched-over a semi-spherical surface 18*a* of a cap 13*a* and secured thereon by an elastomeric O-ring 23. An annular groove 24 is formed on the lower periphery of the cap to seat the O-ring therein. Threads 22*a* are formed on the dispenser to receive an internally threaded cap 14*a* of conventional design. A disinfectant pad (not shown), similar to pad 20, can be secured within cap 14*a*** to overlie the filter when the cap is closed.

Figure 4:
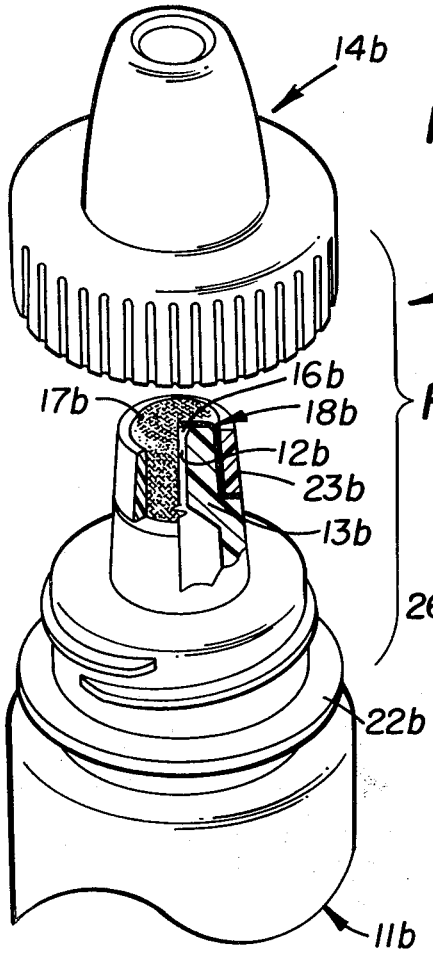
FIG. 4 is similar to FIG. 3, but illustrates a third dispenser embodiment.

FIG. 4 illustrates a third dispenser embodiment **11*b* wherein corresponding constructions are depicted by identical numerals, but wherein numerals appearing in FIG. 4 are accompanied by a "b". This embodiment also resembles a standard dropper bottle comprising a squeezable plastic container 11*b* having a cap 14*b* removably mounted thereon by interengaging screw threads. A slightly convex filter 17*b* is stretched over a dispensing spout 13*b* of the dispenser and is secured thereon by a combined sealing and clamping ring 23*b***. The spout is preferably tapered in an upward direction (frusto-conical) along with the inner bore of the ring to provide a tight friction fit between the ring and the spout to clamp the filter therebetween.

A dispensing means **16*b* is defined at the termination of a single longitudinal dispensing passage 12*b* formed centrally of spout 13*b*. The dispensing means terminates at a convex surface 18*b* (when viewed in cross section) formed at the apical end of spout 13*b* to induce coalescence of the dispensed liquid into droplet form. The diameter of the standard dispensing passage approximates 1.0 mm. If so desired, a disinfectant pad (not shown) can also be secured within an upper end of cap 14*b* to overly passage 12*b*** when the cap is in its closed position.

Figure 5:
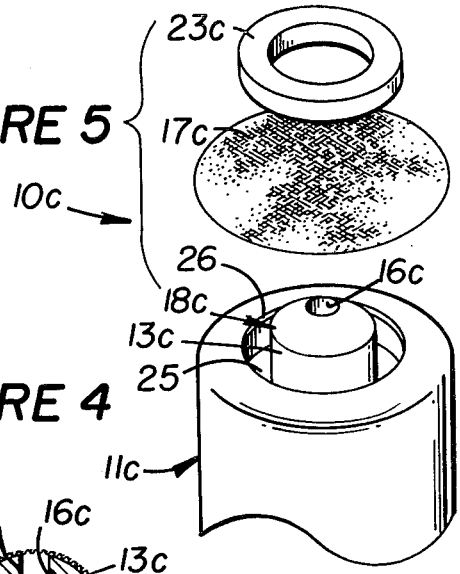
FIGS. 5 and 6 illustrate a fourth dispenser embodiment.
Figure 6:
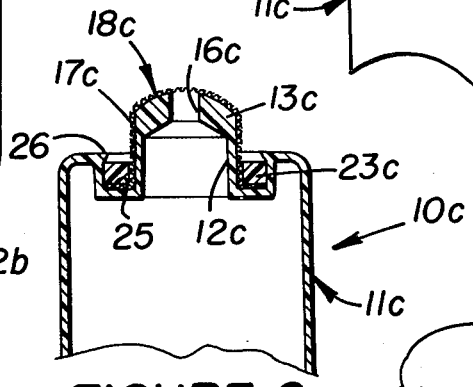

FIGS. 5 and 6 illustrate a fourth dispenser embodiment **10*c* wherein identical numerals, each accompanied by a "c", also depict corresponding constructions. A squeezable container 11*b* of the dispenser terminates at its upper end at a centrally-disposed spout 13*c*, having a single dispensing passage 12*c* formed centrally therein. The passage terminates at a dispensing means 16*c*. A filter 17*c* is stretched-over a convex outer surface 18*c* of the spout and is secured thereon by a combined sealing and clamping ring 23*c***.

The ring may be wedged and seated within a depressed annular groove 25, formed around the spout. An annular, flexible lip 26 may be formed on the container to overly the clamping ring to retain it in the position. In addition, the open annular area above the clamping ring and adjacent to the lip can be filled with a water-tight plastic adhesive (not shown) to fully seal this area and aid in retaining the clamping ring in place, if so desired. A conventional cap can be detachably mounted on spout **13*c*** for storage purposes.

Figure 7:
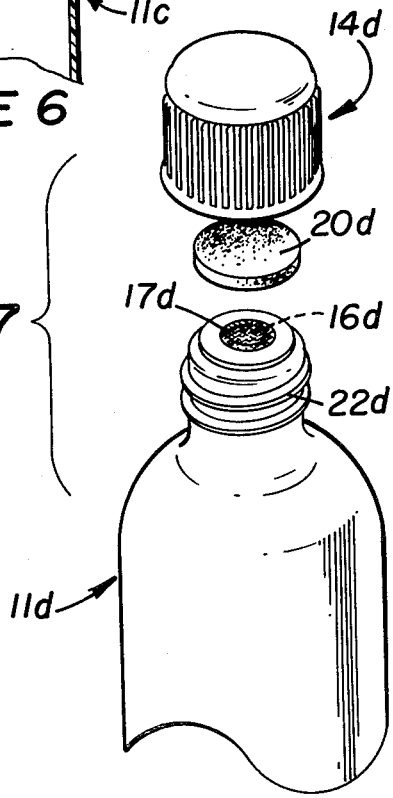
FIGS. 7 and 8 illustrate a fifth dispenser embodiment.
Figure 8:
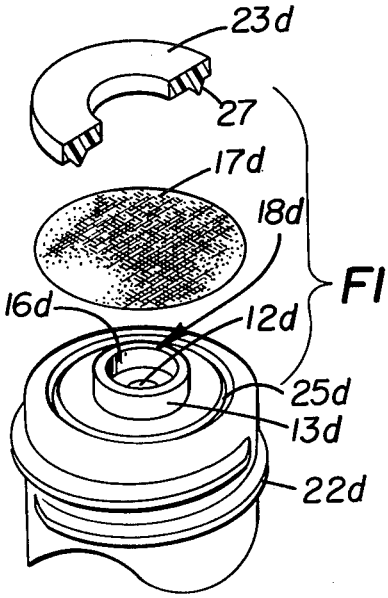

FIGS. 7 and 8 illustrate a fifth dispenser embodiment **10*d* wherein identical numerals, each accompanied by a "d", also depict corresponding constructions and components. The dispenser comprises a squeezable container 11*c* having screw threads 22*d* formed externally on its neck to threadably receive a cap 14*d* thereon. An annular spout 13*d* is formed integrally on the upper end of the neck of the container and defines the centrally-disposed dispensing passage 12*d* therethrough, terminating at a dispensing means 16*d***.

A round filter **17*d* is stretched-over the spout and port 16*d* and is clamped on the container by a combined sealing and clamping ring 23*d*, having an inside diameter suitably sized to frictionally engage and tightly lock the filter on the spout. An annular rib 27 may be formed on the underside of ring 23***d* to engage within an annular groove 25*d* formed on the container to precisely center the ring thereon. A suitable adhesive can be also utilized to aid in securing the ring on the container, if so desired.

From the above description, it can be seen that each of the various embodiments of applicants' invention includes an enclosure system for homogeneous liquids, such as a saline solution or medicinal drops, providing a barrier to the entry of bacteria and particulate matter, while yet allowing the user to dispense the sterile contents numerous times. The liquid solution, once packaged in the dispenser, will retain its sterility regardless of the number of times the solution is dispensed, without requiring the addition of chemical disinfectants or preservatives thereto. The dispenser will allow the economical packaging of large volumes of solution, while maintaining its sterility, which now necessitates expensive unit dose packaging. In addition, the enclosure system assures removal of particulate matter as the solution is dispensed. Utilization of disinfectant pad 20 will further aid in preventing bacterial growth, exteriorly of the dispenser in the area of its dispensing means.

We claim:

1. A liquid dispenser comprising a container defining a liquid retaining chamber therein, dispensing means defined at an upper end of said dispenser for providing the sole dispensing outlet from said chamber, and an entirely hydrophobic and microporous anti-bacterial filter means secured in exposed relationship over said dispensing means for providing a barrier to the ingress of bacteria and particulate matter therethrough, for permitting the egress of sterile liquid from said chamber therethrough, and for repelling residual liquid therefrom, and means for inducing coalescence of liquid dispensed through said dispensing means into droplet form including a convex surface, when viewed in cross-section, formed at the upper end of said dispenser and having said dispensing means defined therethrough and said filter means secured thereover.

2. The liquid dispenser of claim 1 wherein said convex surface is semi-spherical.

3. The liquid dispenser of claim 1 wherein said dispensing means comprises a plurality of spaced ports formed through said convex surface and having a composite cross-sectional area approximating 1.0 mm.

4. The liquid dispenser of claim 1 wherein said dispensing means constitutes a single opening formed centrally through said convex surface and having a cross-sectional area approximating 1.0 mm.

5. The liquid dispenser of claim 1 wherein said filter means comprises a microporous filter secured over said convex surface and said dispensing means and having a pore size in the range of from 0.1 to 5.0 microns.

6. The liquid dispenser of claim 5 wherein the pore size of said filter approximates 0.2 microns.

7. The liquid dispenser of claim 6 wherein said filter is composed of polycarbonate and is bonded over the convex surface of said dispenser.

8. The liquid dispenser of claim 1 further comprising a separate cap secured on an upper end of said container and wherein said dispensing means is defined through said cap.

9. The liquid dispenser of claim 8 wherein said convex surface is formed on a centrally-disposed outer surface of said cap and wherein said dispensing means includes a plurality of spaced ports formed through said outer surface.

10. The liquid dispenser of claim 9 wherein said filter means comprises a filter having a pore size approximating 0.2 and said filter is stretched over said ports and the convex surface of said cap.

11. The liquid dispenser of claim 10 wherein the composite area of the pores formed through said filter and overlying said ports is greater than 1.0 mm.

12. The liquid dispenser of claim 1 wherein an upper end of said container terminates at a spout and further comprising a combined sealing and clamping ring securing said filter means on said spout.

13. The liquid dispenser of claim 1 wherein said container is composed of a thin-walled plastic material adapted to be squeezed to dispense liquid droplets through said dispensing means.

14. The liquid dispenser of claim 1 further comprising a cap detachably connected on the upper end of said dispenser and a disinfectant pad disposed in said cap to overlie and directly contact and entirely cover said exposed filter means when said cap is in its closed position on said dispenser.

15. A liquid dispenser comprising a container defining a liquid retaining chamber therein, dispensing means defined at an upper end of said dispenser for providing the sole dispensing outlet from said chamber, an anti-bacterial filter means secured over said dispensing means for providing a barrier to the ingress of bacteria and particulate matter therethrough and for permitting the egress of sterile liquid from said chamber therethrough, and means defined adjacent to said dispensing means for inducing coalescence of liquid dispensed through said dispensing means into droplet form including a convex surface, when viewed in cross-section, having said dispensing means defined therethrough, said dispensing means comprising a plurality of spaced ports formed through said convex surface and having a composite cross-sectional area approximating 1.0 mm.

16. A liquid dispenser comprising a container defining a liquid retaining chamber therein, dispensing means defined at an upper end of said dispenser for providing the sole dispensing outlet from said chamber, and an anti-bacterial filter means secured over said dispensing means for providing a barrier to the ingress of bacteria and particulate matter therethrough and for permitting the egress of sterile liquid from said chamber therethrough, and a cap on an upper end of said container and wherein said dispensing means is defined through said cap, a centrally-disposed outer surface of said cap being convex, when viewed in cross-section, and wherein said dispensing means includes a plurality of spaced ports formed through said surface.

17. A liquid dispenser comprising a container defining a liquid retaining chamber therein and having a convex surface, when viewed in cross-section, formed on an upper end thereof, dispensing means defined at the convex surface of said dispenser for providing the sole dispensing outlet from said chamber, an entirely hydrophobic and microporous anti-bacterial filter means secured in exposed relationship over said convex surface and said dispensing means for providing a barrier to the ingress of bacteria and particulate matter therethrough, for permitting the egress of sterile liquid from said chamber therethrough and for repelling residual liquid therefrom, and a cap detachably connected on the upper end of said dispenser and a disinfectant pad disposed in said cap to overlie and directly contact and entirely cover said exposed filter means when said cap is in its closed position on said dispenser.

* * * * *